US010525989B2

(12) United States Patent
Chambers et al.

(10) Patent No.: US 10,525,989 B2
(45) Date of Patent: Jan. 7, 2020

(54) RAIL CAR KEY ADAPTOR TOOL

(71) Applicants: Quintin E. Chambers, Tacoma, WA (US); Deborah J. Bussell-Chambers, Tacoma, WA (US)

(72) Inventors: Quintin E. Chambers, Tacoma, WA (US); Quintin J. Bussell-Chambers, Tacoma, WA (US)

( * ) Notice: Subject to any disclaimer, the term of this patent is extended or adjusted under 35 U.S.C. 154(b) by 247 days.

(21) Appl. No.: 15/818,758

(22) Filed: Nov. 21, 2017

(65) Prior Publication Data

US 2018/0178817 A1 Jun. 28, 2018

Related U.S. Application Data

(60) Provisional application No. 62/429,700, filed on Dec. 2, 2016.

(51) Int. Cl.
*B61D 7/30* (2006.01)
*B61D 7/26* (2006.01)
*B61D 7/02* (2006.01)

(52) U.S. Cl.
CPC ..... *B61D 7/30* (2013.01); *B61D 7/26* (2013.01); *B61D 7/02* (2013.01)

(58) Field of Classification Search
CPC ... B61D 7/16; B61D 7/24; B61D 7/26; B61D 7/28; B61D 7/30; B61D 19/00
See application file for complete search history.

(56) References Cited

U.S. PATENT DOCUMENTS 3,667,400 A * 6/1972 Damy ..... B61D 7/12 105/239
3,789,772 A * 2/1974 Bullard ..... B61D 7/28 105/240
2013/0202344 A1* 8/2013 Curtis ..... E04F 15/142 403/28
2018/0178817 A1* 6/2018 Chambers ..... B61D 7/30

FOREIGN PATENT DOCUMENTS

FR 2805521 A1 * 8/2001 ..... B65D 19/16

OTHER PUBLICATIONS

'Atlantic Pallet Exchange' (APE) Oct. 14, 2016. Retrieved from the Internet on Jan. 9, 2018. URL: <https://web.archive.org/web/20161014071336/http://atlanticpallet.com/general-pallet-info.htm>.*

* cited by examiner

*Primary Examiner* — Jason C Smith

(57) ABSTRACT

A rail car key adaptor tool made of a shank piece with width less than 1½ inches is connected to another durable material piece in which one material piece is longer than the other at 90 degree on the long side. Top plate with two arms is connected to the shank piece at the edge at 90 degree. A durable triangle piece connecting the two arms next to the shank piece; and a round handle connected at both of arms of the top plate.

7 Claims, 5 Drawing Sheets

RAIL CAR KEY ADAPTOR TOOL

CROSS REFERENCE TO RELATED APPLICATION

This application claims the benefit of U.S. Provisional Patent Application No. 62/429,700, filed Dec. 2, 2016, the entire disclosure of which is incorporated herein by this reference.

BACKGROUND

In the United States, significant amounts of commodities are transported in rail cars on transport trains. After a product, such as grain, is loaded into a railcar, when the rail car has reached its destination, the grain needs to be unloaded. Railcars have hopper gates which allow the grain to be unloaded into grain silos.

The railcars for grain have a female receiver/hub on each side of the axle, which makes it convenient using a square male tool to open the hopper gate to unload the grain. The receiver has a square female 1½ inches×1½ inches receiver which when turned opens the rail car hopper gate. There is a heavy square male adaptor tool (e.g., a Car Door Opener [C.D.O.] machine) which is powered by a motor which fits into the female receiver to open the hopper gate. Often, the square male has difficulty fitting into the female square receiver, because of the variety of C.D.O. machines across the United States, or the male adaptor has worn the square receiver of the female into an oblong shape. Over 50% of the female receivers on the rail cars in United States have this problem, this is especially pertinent to the train cars which are five years or older. This wear from the male receiver continues to cause this stripping of the female receiver through regular use. The current solution available in the marketplace today, is to use larger and heavier accessories (between 20-40 lb.) that assist the rail car door operator to fit into the female receiver to open the hopper trap door. This makes it a two man job. Putting many laborers at risk of injuries. This invention addresses this problem with a light low cost innovative solution allowing it to be a one man job. The invention addresses all designs that use this mechanism on a day to day basis.

SUMMARY

A Rail Car Key Adaptor tool is made of a shank piece with width less than 1½ inches connected to a durable material piece in which one material piece is longer than the other by at least ¾ inches at 90 degree on the long side. The shank piece is typically made of US gauge steel. A top plate with two arms is connected to shank piece at the edge at 90 degree wherein the length of the arm is 4 inches and width 1½ inches. A Gusset (a durable triangle piece) connects the two arms next to the two durable material pieces; and a handle connected at both of the arms of the top plate. The dimension of the handle is typically 2¼ inches height and 5 inches width and is made out of a round bar.

DETAILED DESCRIPTION

This invention is a Rail Car Key Adaptor, which fits in the female receiver and/or hub portion of the rail car below the hopper. The size of the adaptor is small enough for one worker to use it to open a rail car hopper gate.

In this invention, the definition of approximately refers to ½ inch tolerances when referring to inches. Further, the definition of approximately refers to 2-3 degree variations when referring to angles.

In one embodiment, the Rail Car Key Adaptor has a top plate with a typical dimensions approximately 5½ inches height with a 1½ inches×1½ inches×5/16 inches depth, with a triangular gusset connecting two 4 inches long section which gives it extreme strength. The approximately 1½ inches×1½ inches×¼ inch depth US steel angle iron extends approximately 3¼ inches long with a 1¼ inches cut out, in the event, the CDO machine bends the tool, it can easily be removed by a crowbar.

In another embodiment, the handle is a ½ inches round stock of US made mild steel, with an approximately 1¾ inches rise off the two plate arms, and it makes an approximately 1¾ degree vertical angle, with approximately 1¾ inches in height and making a approximately 90 degree bend with approximately 4¾ inches long width in a horizontal direction. The dimensions of handle allow space for the worker to pull the Rail Car Key Adaptor tool out of the female receiver with little effort.

In another embodiment, the Rail Car Key Adaptor tool can be made out of heavy gauge steel or any hard and durable material and is not limited to such material as plastic and composite materials. The Rail Car Key Adaptor tool needs to be strong and durable because it is constantly being used as an adaptor between the female square receiver and the Car Door Opener machine on thousands of rail cars. The adaptor is typically made out of ⅜ inch thick steel for the shank piece. This invention is not limited to the dimensions typically used. For other materials, the thickness of the adaptor can be thinner or thicker depending on the strength of the durable material being used.

Figure 1:
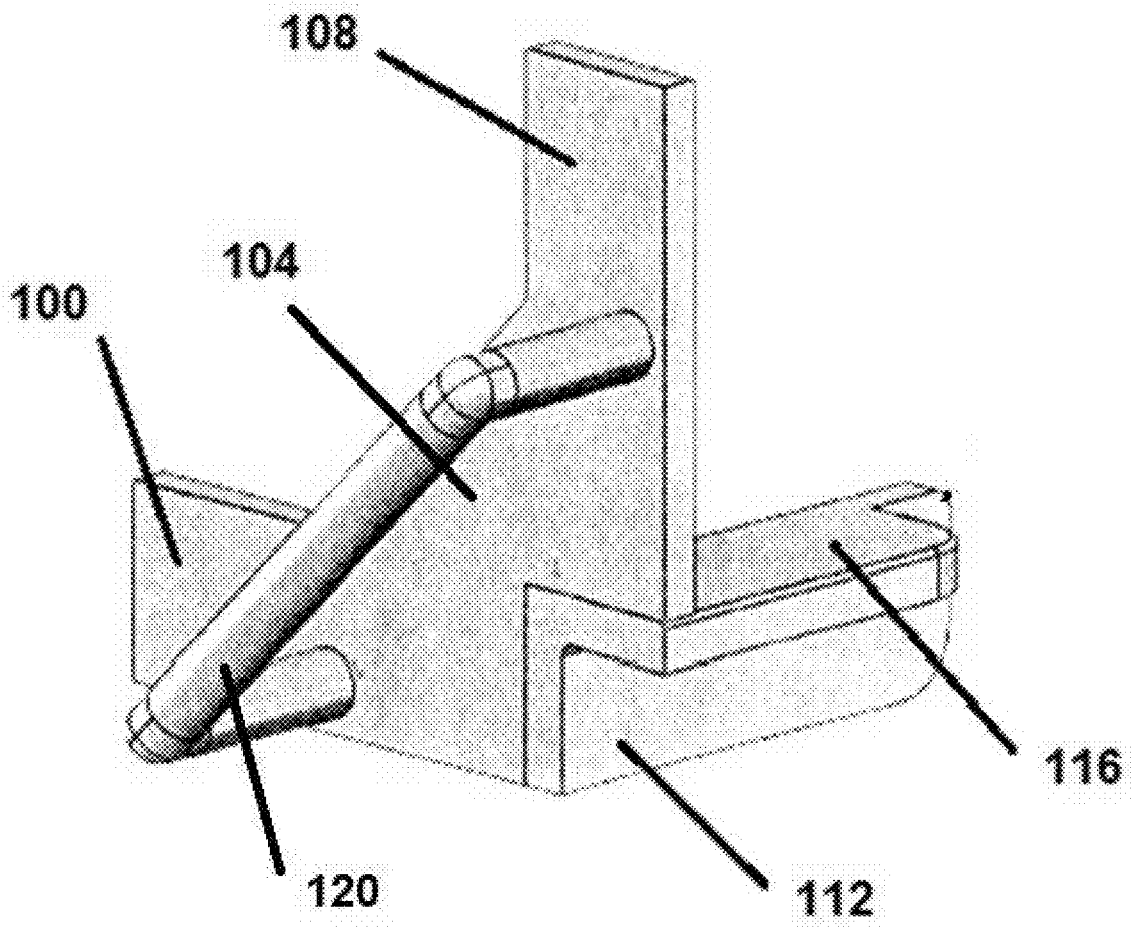
FIG. 1 shows a front perspective of the Rail Car Key Adaptor tool.
Figure 2:
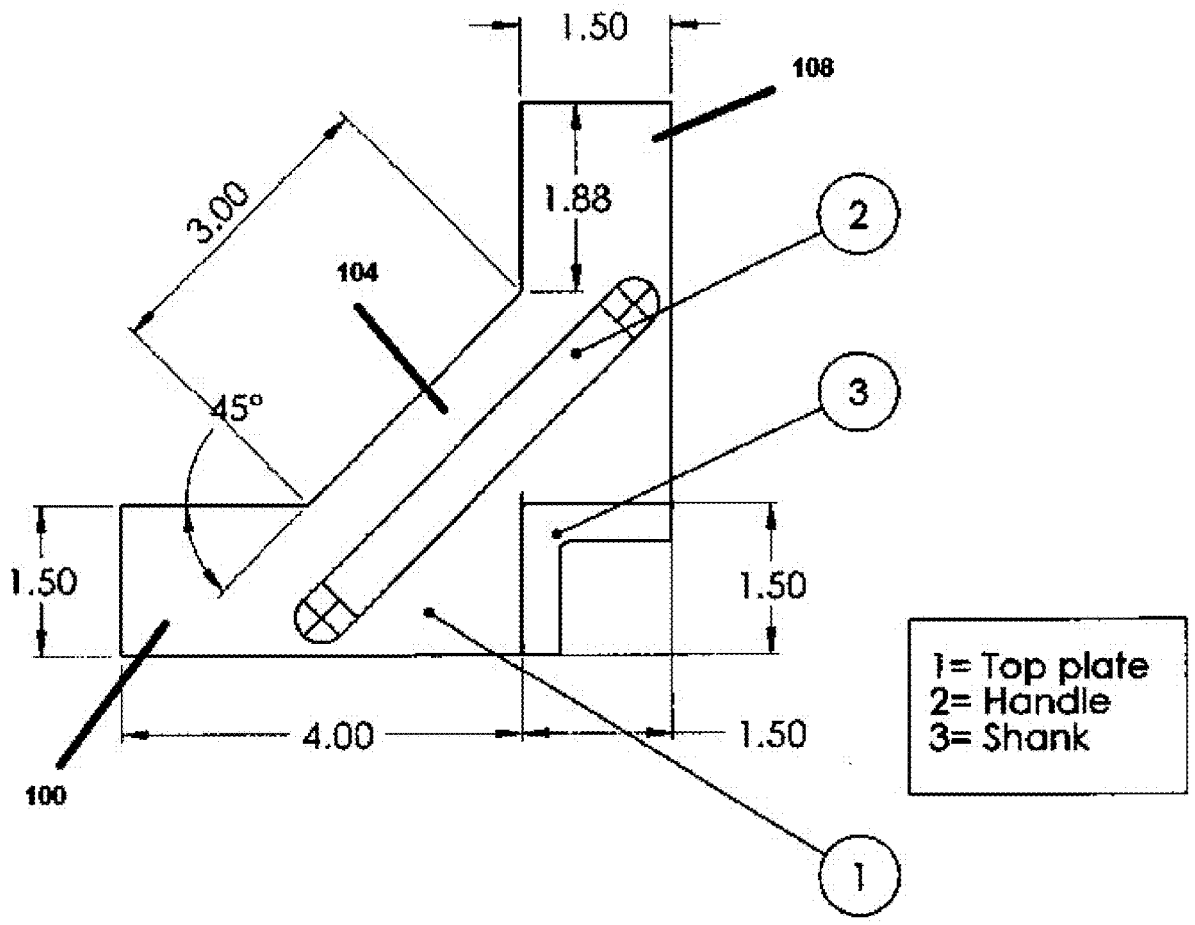
FIG. 2 shows a front view of the top plate for the Rail Car Key Adaptor tool with typical dimensions.

An embodiment of the key adaptor is described below. FIG. 1 shows a perspective view of an embodiment of the Rail Car Key Adaptor tool. The top plate, as shown in FIG. 2, is L-shaped. The top plate is made of a durable section 100 (making up one portion of the L) with typical dimension of approximately 4 inches by 1½ inches and is connected at the short edge to another section 108 (making up the other portion of the L) with dimension of approximately 4 inches by approximately 1½ inches at approximately 90 degree angle. The connection between 100 and 108 sections can be welded, glued together or manufactured in one segment.

The edge connection between two sections of the top plate can be strengthened using a right angle triangular gusset. The dimensions of the right angle triangle piece 104 are approximately 1½ inches by 1½ inches by 2 2/16 inches with approximately 45 degree angle. The top plate can be machined from a single piece of durable material combining the two sections and the triangular section from a single durable material.

Figure 3:
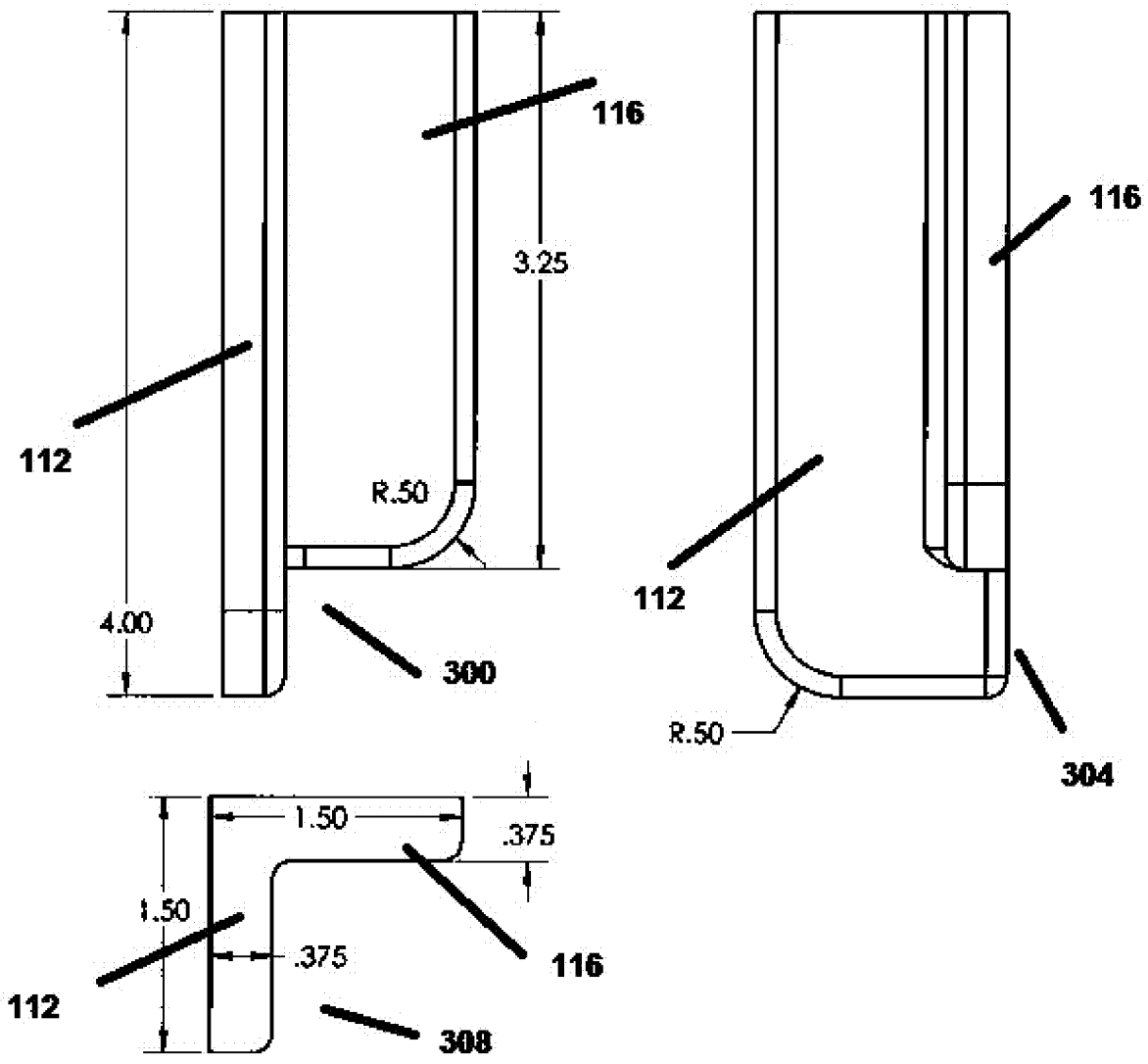
FIG. 3 shows shank piece associated with the Rail Car Key Adaptor tool with typical dimensions.
Figure 4:
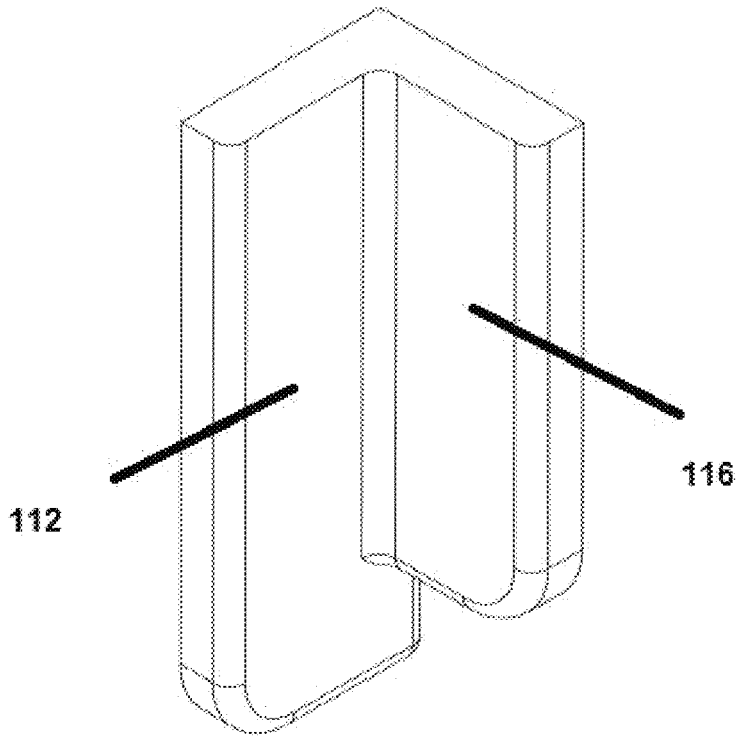
FIG. 4 shows a perspective view of the shank piece associated with the Rail Car Key Adaptor tool with typical dimensions.

FIG. 3 shows the shank piece which is made of a durable material piece 112 with dimension of approximately 4 inches by 1½ inches rounded edge is connected along the long edge to another piece 116 with dimension of approximately 3¼ inches by 1½ inches at approximately 90 degree angle rounded edge. FIG. 3 shows side views 300, 304 of the shank piece and the edge view 308 of the shank piece. FIG. 4 shows a perspective view of the shank piece in which one piece 112 is connected to the other piece 116 at the long edge. In the above configuration, one piece 112 of the shank piece is longer than the other piece 116 by at least 1 inch. The total width of two pieces of the shank piece is no more than 1½ inches. FIG. 1 shows front perspective view of the Key Adaptor tool connecting piece the top plate with the shank piece. The pieces of the shank are attached to each other along the long edge. FIG. 3 shows the connection between two pieces of the shank piece connected along the long edge at a 90 degree angle. The top plate is connected to the shank piece at an approximately 90 degree angle at the corner of the L-shaped piece.

In one embodiment, the shank piece can fit into the top plate by connecting to the top plate at the corner of the L-shaped with a slotted taken out to fix the shank piece.

The shank piece fits into the square female receiver which controls the rail car trap door. The shank piece takes the wear and tear when used in operating the rail car hopper opener. The top plate is designed for stability and durability; in addition, it limits how far the shank piece fits into the female receiver portion of the rail car hopper gate door. In another embodiment, the shank piece is made from approximately ⅜ inch thick steel pieces. Using the ⅜ inch thick steel for the adaptor allows it to last longer before wearing out.

Even though the adaptor can be made from multiple pieces of durable material, the adaptor can be manufactured from a minimal number of pieces. For example, the Rail Car Key Adaptor can be made from a single piece of steel or metal. Further, the adaptor can be manufactured using an injection molding to produce a single piece using a die cast.

Figure 5:
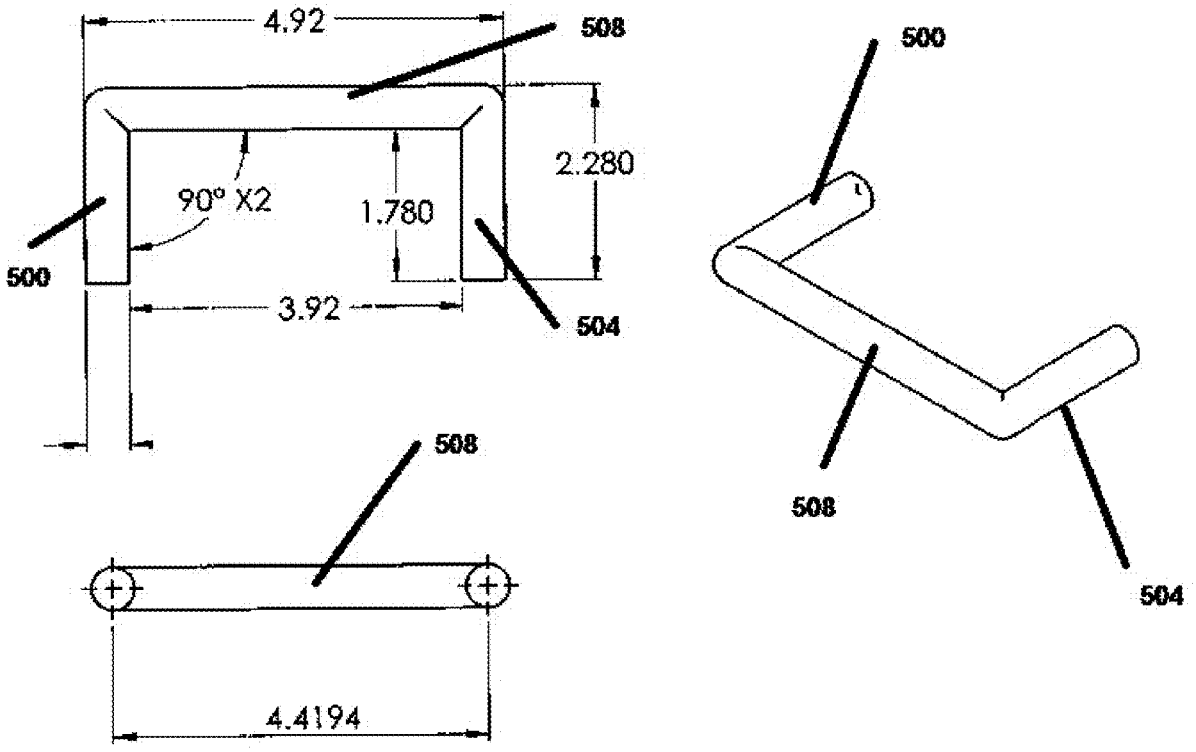
FIG. 5 shows handle piece associated with the Rail Car Key Adaptor tool with typical dimensions.

FIG. 1 show the handle 120 attached to the top plate. The handle is used to push the Rail Car Key Adaptor into the female receiver used to open the rail car hopper gate. The handle is necessary to insert and remove the key adaptor from the female receiver after the rail car hopper door has been opened. FIG. 5 shows an example embodiment of the rail car key adaptor handle with typical dimensions. The round handle is needed so that the rail car key adaptor tool can be easily gripped by a human operator. The handle on the rail car key adaptor is made of a round durable material with a dimension of at least a ¼ inch. Typically, the durable material is made of mild grade US steel. The handle is made of two 2¼ inches pieces 500, 504 connected to each side of the L shaped top plate. The two pieces 500, 504 are connected by 5 inches piece 508.

In an alternative embodiment, the round handle has a piece (with a length of 1⅝ inch) connected to the piece at 3¾ inches along the long edge and ¾ inch from the short edge. The other end of the round handle is attached to the piece at 3¾ inches along the long edge and ¾ inch from the short edge. The width of the round handle is ¼ inch. The top portion of the round handle is made of two hard material connected at 90 degrees and has lengths of 1¾ inches. These are example dimensions and should not be construed as the only dimension covered by the invention.

The adaptor handle is typical made from a single piece of durable material. In the embodiment shown, the adaptor handle is made from a round steel rod. The adaptor handle can be glued or welded to attach the handle to the rail car key adaptor.

The current design of the rail car key adaptor tool is universal and covers all safety guidelines. In another embodiment, rail car key adaptor tool which is made out of metal or steel can be also magnetized by milling two ¾ inch holes on the backside of the top plate near the shank. This will allow it to attach itself for enhanced safety benefits. The shank piece of the rail car key adaptor tool is also able to be magnetized. The adaptor being magnetized ensures that the rail car key adaptor tool is securely locked into place when the rail car hopper opener is being used.

All examples and conditional language recited herein are intended for educational purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents hereof. Additionally, it is intended that such equivalents include both currently known equivalents as well as equivalents developed in the future, i.e., any elements developed that perform the same function, regardless of structure.

The invention claimed is:

1. A rail car key adaptor comprising of:

a shank piece made of a durable material piece connected to a durable material piece at 90 degree on a long side, in which one piece is longer than the other piece and with total width of said shank piece is less than 1½ inch;

a top plate with two arms are connected to said shank piece where the two arms connect and at 90 degree;

a triangular gas set piece connecting the two arms of the top plate; and a handle connected at both of arms of the top plate.

2. A rail car key adaptor comprising of:

a shank piece made of a durable material piece connected to a durable material piece at 90 degree on the long side, in which one piece is longer than the other and with width of each piece is less than ½ inch;

a top plate with two arms are connected to said shank piece at the edge at 90 degree wherein each arm is connected to each other in a L shape formation on a flat side and a length of each arm is at least 4 inches and a width 1½ inches with a thickness at least 5/16 inches;

a triangular gusset piece connecting the two arms of said top plate with dimensions of at least 2⅛ inches×2⅛ inches×3 inches; and a handle connected at both of arms of the top plate.

3. The adaptor in claim 1 wherein said durable material piece is made of a mild grade steel and the thickness of the steel is at least ¼ inch.

4. The adaptor in claim 1 wherein said durable material piece is durable plastic.

5. The adaptor in claim 2 wherein said durable material is steel and the thickness of the steel is at least ¼ inch.

6. The adaptor in claim 2 wherein said durable material is durable plastic.

7. The adaptor in claim 2 wherein said handle is made of round durable material has the dimension of at least 5 inches width and height of at least 2¼ inches.

* * * * *